US006607603B1

(12) United States Patent
Fougnies

(10) Patent No.: US 6,607,603 B1
(45) Date of Patent: Aug. 19, 2003

(54) METHOD FOR MAKING CRYSTALLIZED FRUCTOSE

(75) Inventor: Christian Fougnies, Wiers (BE)

(73) Assignee: Warcoing S.A., Warcoing (BE)

( * ) Notice: Subject to any disclaimer, the term of this patent is extended or adjusted under 35 U.S.C. 154(b) by 0 days.

(21) Appl. No.: 09/743,157

(22) PCT Filed: Jul. 5, 1999

(86) PCT No.: PCT/EP99/04732

§ 371 (c)(1),
(2), (4) Date: Jan. 5, 2001

(87) PCT Pub. No.: WO00/03040

PCT Pub. Date: Jan. 20, 2000

(30) Foreign Application Priority Data

Jul. 8, 1998 (EP) ..... 98202278

(51) Int. Cl.[7] ..... C13F 1/02; C13K 11/00
(52) U.S. Cl. ..... 127/60; 127/30
(58) Field of Search ..... 127/30, 60

(56) References Cited

U.S. PATENT DOCUMENTS 3,883,365 A * 5/1975 Forsberg et al. ..... 127/15

4,861,382 A * 8/1989 Goodacre et al. ..... 127/60

OTHER PUBLICATIONS

English translation of citation from the Römpp Lexikon Chemie by Georg Thieme Verlag (no date provided).

* cited by examiner

*Primary Examiner*—David Brunsman
(74) *Attorney, Agent, or Firm*—Maria Parrish Tungol

(57) ABSTRACT

The invention relates to a method for making crystallized fructose comprising preparing a pure fructose syrup by melting fructose dihydrate crystals, concentrating the melt by heating under reduced pressure to obtain a dry matter content above 96% by weight, seeding the concentrated syrup with fructose crystals, and solidifying the seeded syrup. In a preferred process, the time between the melting the fructose dihydrate crystals and the concentration of the syrup to a dry matter content above 96% by weight is less than 24 hours, preferably less than 8 hours. The invention also relates to crystallized fructose produced by the process of the present invention wherein the fructose is comprised primarily of the beta-D-fructopyranose fructose crystals tautomers with low amounts of other fructose tautomers which are considered impurities in the crystallization context.

13 Claims, No Drawings

METHOD FOR MAKING CRYSTALLIZED FRUCTOSE

This application is a 371 of PCT/EP99/09732 filed Jul. 25, 1999.

The present invention addresses a process for manufacturing crystalline fructose by crystallizing/solidifying a purified and concentrated fructose syrup.

The preparation of crystalline fructose from sugar syrups, particularly syrups containing both fructose and glucose is known per se but involves a number of practical problems.

U.S. Pat. No. 2,588,449 discloses a process for preparing crystals of fructose dihydrate $C_6H_{12}O_6.2H_2O$, by cooling and seeding a fructose solution. However, the product obtained thereby, fructose dihydrate, is only stable at relatively low temperatures and can be neither stored nor transported without particular precautions to prevent liquefaction thereof.

On the other hand the so-called "anhydrous" fructose (see U.S. Pat. No. 3,513,023) is known. The methods for crystallizing this product are either relatively complex and costly, e.g. using alcoholic solutions (see U.S. Pat. No. 3,607,392), or appear to be ineffective in practice due to isomerization of fructose in the aqueous phase. Particularly, this is the case of the process according to U.S. Pat. No. 3,513,023: when the conditions claimed by this patent are recreated experimentally, it happens that fructose "mutarotation" (equilibrium reaction between the five isomers of fructose, i.e. beta-D-fructopyranose, beta-D-fructofuranose, alpha-D-fructofuranose, alpha-D-fructopyranose and the ketonic, noncyclic form of fructose) causes the formation of noncrystallizable isomers, which considerably affects crystallization by solidification.

The present invention has the object to provide a new fructose crystallization process while obviating the problems of prior art and to obtain a form of commercially useable crystalline fructose.

SUMMARY OF THE INVENTION

The present invention relates to a method for making crystallized fructose comprising preparing a pure fructose syrup by melting fructose dihydrate crystals, concentrating the melt by heating under reduced pressure to obtain a dry matter content above 96% by weight, seeding the concentrated syrup with fructose crystals, and solidifying the seeded syrup. In a preferred process, the time between the melting the fructose dihydrate crystals and the concentration of the syrup to a dry matter content above 96% by weight is less than 24 hours, preferably less than 8 hours. The invention also relates to crystallized fructose produced by the process of the present invention wherein the fructose is comprised primarily of the beta-D-fructopyranose fructose crystals tautomers with low amounts of other fructose tautomers which are considered impurities in the crystallization context.

DETAILED DESCRIPTION OF THE INVENTION

This new process for manufacturing crystallized fructose, including solidification of a hot and concentrated fructose solution after seeding the solution with fructose crystals is characterized by the use of a fructose solution resulting from a pure fructose syrup, freshly prepared by melting crystals of fructose dihydrate, and concentrated by evaporation in a vacuum to obtain a dry matter content above 96% by weight, and preferably above 97% by weight.

In accordance with an additional characteristic of the invention, the fructose solution used for seeding preferably has a temperature of 50 to 100° C., ideally of 80 to 95° C.

Also, seeding is preferably performed with 5 to 30% by weight of finely grained crystallized fructose, particularly having a particle size of less than 500 $\mu$m, preferably less than 250 $\mu$m (for instance 50 $\mu$m).

According to another additional characteristic of the invention, the time between melting of fructose dihydrate crystals to prepare the starting syrup and concentration of said syrup to a dry matter content above 96% by weight, preferably above 97% by weight is preferably of less than 24 hours, more particularly less than 8 hours, and ideally less than half an hour.

The invention also relates to a general process for manufacturing crystallized fructose from a syrup containing fructose and possibly other substances (for instance other sugars, proteins, etc.), including the following successive steps:

seeding, with crystals of fructose dihydrate, the aqueous solution of fructose having a total sugar content of 45 to 65% by weight and a fructose content above 60% by weight, referred to the dry matter, at a temperature of 10 to −10° C., keeping the solution in fructose supersaturation conditions, by progressively lowering temperature until crystals of the desired size are obtained, and separating the crystals obtained from the mother liquor to obtain crystals of fructose dihydrate having a fructose content of 95 to 100% by weight referred to the dry matter;

melting the crystals collected in a syrup having a content of about 83% by weight of sugar and about 17% of water;

concentrating the syrup obtained thereby by water evaporation under limited pressure, preferably a pressure of less than a column of mercury 60 mm high, until a dry matter content above 96% by weight, preferably of 97 to 100% by weight is reached;

seeding the syrup obtained thereby by means of 5 to 30% by weight of crystallized fructose, preferably at a temperature of 80 to 95° C.;

keeping the mass obtained thereby at a temperature of 55 to 75° C., until a nontacky and brittle mass is obtained, and crushing, drying and grinding this mass into particles formed by crystals of agglomerated fructose.

It will be understood that a possible water addition upon melting of crystals of fructose dihydrate, and the consecutive removal of said added water upon concentration of the syrup until a dry matter content of 96 to 100% by weight is reached are absolutely equivalent to the method which provides melting of crystals as collected, provided that the time between syrup formation and concentration thereof is as short as possible (particularly below 24 hours).

The invention also relates, as a new product, to crystallized fructose, essentially consisting of beta-D-fructopyranose, having a poor content of other fructose tautomers, resulting from a method of solidification of a hot and concentrated fructose solution, after seeding the solution with crystals of fructose, in which the fructose solution used for seeding results from a pure fructose syrop freshly prepared by melting crystals of fructose dihydrate, concentrated by evaporation in a vacuum to a dry matter content of 96 to 100% by weight, the fructose solution used for seeding preferably has a temperature of 80 to 95° C. and seeding is performed by using 5 to 30% by weight of crystallized fructose having a particle size of less than 500 μm, preferably of less than 250 μm, and the time elapsing from melting of fructose dihydrate crystals to prepare the starting syrup to concentration of said syrup to a dry matter content above 96% is of less than 8 hours, preferably less than half an hour.

The following examples will be useful to disclose the invention and specify a few preferred details and embodiments, without limiting thereby the scope as defined in the claims below.

EXAMPLE I

Purification of a glucose and fructose solution: obtaining crystals of fructose dihydrate $C_6H_{12}O_6.2H_2O$ Crystals of fructose dihydrate are obtained by progressively cooling an aqueous solution of glucose and fructose whose total sugar content is of 45 to 85% and in dry matter, fructose concentration is of 60 to 100%.

During the cooling process, when the saturation concentration of fructose dihydrate is obtained, crystals of fructose dihydrate are added in the mass of the syrup from the outside. This addition of external crystals, named seeding, takes place at a temperature ranging from 10 to −10° C. depending on dry matter concentration and on dry matter composition.

After seeding, the temperature of the mass so seeded, is progressively lowered and thereafter kept in such fructose supersaturation conditions that the existing crystals increase progressively whereas the appearance of new crystals is limited.

Once the crystals have reached the desired size, the syrup mass containing the crystals is conveyed towards a continuous or discontinuous centrifuge, similar to those used in sugar production. Any other physical solid/liquid separation method may be provided.

Crystallization mother liquor, which consists of any non-crystallized water and sugars of the starting solution may be submitted to a new crystallization stage as described above.

The fructose dihydrate crystals, thereby separated, may be washed for maximum removal of the mother liquor film which surrounds them thereby improving fructose purity to values of 90% to 100%, preferably of 97.5% to 100%. Then, they are melted, preferably at temperatures above 20° C. If no water is added during melting, the syrup obtained from properly washed crystals contains 83% of sugars and 17% of water. The dry matter of this syrup only contains a few traces of the other mother liquor sugars.

EXAMPLE II

Concentration of a syrup obtained by melting crystals of fructose dihydrate.

The syrup has a 83% of dry matter obtained according to the example 1 and concentrated at temperatures of the order of 65 to 100° C. under pressures of less than a 60 mm high column of mercury, for a time of less than 30 minutes, or less than 15 minutes. The required maximum temperature decreases with decreasing concentration pressure, thereby reducing the risk of discoloration of the concentrated syrup.

Depending on temperature, pressure and concentration time, the dry matter of the concentrated syrup varies from 96.0 and 100.0%. At an outlet temperature of the order of 90° C., the syrup is relatively viscous and may be conveyed, i.e. pumped to be subsequently crystallized/solidified.

Note:

In fructose dihydrate crystals, as well as in fructose crystals, the fructose molecule only has the form of beta-D-fructopyranose. Conversely, in the aqueous solution, fructose is subject to a mutarotation phenomenon. In equilibrium, the solution contains the following 5 isomers:

beta-D-fructopyranose, beta-D-fructofuranose, alpha-D-fructofuranose, alpha-D-fructopyranose and the ketonic noncyclic form of fructose (the latter 2 forms being much minor portions). Only the first of the above isomers may enter the crystal texture of fructose, whereas the others shall have to be considered as impurities in the crystallization context. In order to prevent as far as possible the formation of these non-crystallizable isomers, syrups (obtained by melting dihydrate crystals) should be rapidly concentrated, to a dry matter content preferably above 96.0%, ideally to a dry matter content above 97.0%. Mutarotation takes place as slowly as the water content in the solution is low. If the time from crystal melting to syrup concentration is excessively long, the noncrystallizable isomer content may reach values of the order of 25 to 30% and this affects crystallization of beta-D-fructopyranose to a considerable extent.

EXAMPLE III

Crystallization/solidification of a fresh concentrated syrup.

The concentrated and viscous syrup obtained from Example II is kept in a blender at a temperature of 80 to 95° C. and seeded with 10 to 25% of very finely grained crystallized fructose (<200 μm). Seeding may be performed by using the fructose obtained from the previous process, after grinding it finely. Then, the medium is stirred to ensure optimal dispersion of nuclei therein. The medium consisting of a highly viscous whitish mass is poured out of the blender and stored in an oven whose temperature is set at a value of 55 to 75° C. depending on the residual water content, on the number of nuclei and on the mutarotation progress. The time of permanence in the oven also depends on these factors.

At this stage, crystallization occurs until the whole eventually forms a nontacky, rigid and brittle mass.

It has to be noted that, if a non seeded syrup is treated in the same manner, it will completely vitrify and form an amorphous (noncrystalline) translucent and highly hygroscopic mass which cannot be neither ground nor stored.

The crystallized mass obtained thereby is coarsely ground by means of a grinder. Then, the particles so obtained may be dried at a temperature of 50 to 75° C. (preferably under dry air flow) to further reduce the water content. Then a fine grinding may be performed. If the initial mass is dry enough to be finely ground, the drying step following coarse grinding may be skipped.

The product obtained thereby is composed of particles (whose particle size depends on the fine grinding step), which in turn consist of small agglomerated fructose crystals. In order to remove as much water as possible, a final drying step, at a temperature of 50 to 75° C. takes place at the end of the fine grinding step.

What is claimed is:

1. A process for manufacturing crystallized fructose comprising 1) preparing a pure fructose syrup by melting fructose dihydrate crystals, 2) concentrating the melt by heating under reduced pressure to obtain a dry matter content above 96% by weight, 3) seeding the concentrated syrup with fructose crystals, and 4) solidifying the seeded syrup.

2. The process according to claim 1 wherein the concentrated syrup is seeded at a temperature of 50 to 100° C.

3. The process according to claim 1 wherein the seeding is performed with 5 to 30% by weight of fructose crystals having a particle size of less than 500 μm.

4. The process according to claim 1 wherein the time between the melting the fructose dihydrate crystals and the concentration of the syrup to a dry matter content above 96% by weight is less than 24 hours.

5. The process according to claim 1 wherein the time between the melting of the fructose dihydrate crystals and the concentration of the syrup to a dry matter content above 96% by weight is less than 8 hours.

6. The process according to claim 1 wherein the time between the melting of fructose dihydrate crystals and the concentration of the syrup to a dry matter content above 96% by weight is less than half an hour.

7. The process according to claim 1 wherein the heating is performed in a vacuum.

8. A process for manufacturing crystallized fructose comprising:

preparing a solution of fructose having a total sugar content of 45 to 85% by weight and a fructose content above 60% by weight, referred to the dry matter and seeding the solution with fructose dihydrate crystals at a temperature between 10 to −10° C., progressively lowering the temperature of the seeded solution until fructose dihydrate crystals having a fructose content of 95 to 100% by weight of dry matter are obtained, and separating the crystals from the seeded solution;

melting the resulting crystals to obtain a syrup comprised of about 83% by weight sugar and about 17% water;

concentrating the syrup by evaporating the water under reduced pressure to obtain a dry matter content of 96% to 100% by weight;

seeding the concentrated syrup with 5 to 30% by weight of crystallized fructose, keeping the resulting mass at a temperature between 55 to 75° C. until a nontacky and brittle mass is obtained, and crushing, drying and grinding the nontacky brittle mass into particles of agglomerated fructose crystals.

9. The process according to claim 8 wherein the temperature of the concentrated syrup is between 80 to 95° C.

10. The process according to claim 9 wherein the syrup is concentrated by evaporating the water in a vacuum.

11. The process according to claim 10 wherein the syrup is concentrated to a dry matter content above 96% by weight and the crystals used to seed the concentrated syrup have a particle size of less than 250 μm.

12. A process of producing crystallized beta-D-fructopyranose comprising:

preparing a fructose syrup by melting fructose dihydrate crystals and concentrating the syrup by heating in a vacuum to a dry matter content above 97% by weight, seeding the concentrated syrup at a temperature of 80 to 95° C. with 5 to 30% by weight of crystallized anhydrous fructose having a particle size of less than 500 μm, wherein the time between the melting of the fructose dihydrate crystals and the concentration of the syrup to a dry matter content above 97% by weight is less than half an hour.

13. Crystallized beta-D-fructopyranose prepared by the process of claim 12.

* * * * *